US005417129A

United States Patent [19]

Baron

[11] Patent Number: 5,417,129

[45] **Date of Patent: * May 23, 1995**

[54] RATCHET WRENCH INCLUDING TOOTHLESS DRIVE

[75] Inventor: George A. Baron, Rosenberg, Tex.

[73] Assignee: Han Classic, Houston, Tex.

[ * ] Notice: The portion of the term of this patent subsequent to Nov. 9, 2010 has been disclaimed.

[21] Appl. No.: 149,025

[22] Filed: Nov. 8, 1993

Related U.S. Application Data

[63] Continuation-in-part of Ser. No. 937,129, Aug. 31, 1992, Pat. No. 5,259,276.

[51] Int. Cl.[6] ..... B25B 13/00

[52] U.S. Cl. ..... 81/58.2; 81/59.1; 81/63.1

[58] Field of Search ..... 81/58, 58.2, 59.1, 60, 81/63.1

[56] References Cited

U.S. PATENT DOCUMENTS

| | | | |
|---|---|---|---|
| 1,161,064 | 11/1915 | Meyer | 81/58 |
| 2,551,669 | 5/1951 | Hale | 81/58.2 |
| 2,699,082 | 1/1955 | Viets | 81/58.2 |
| 2,766,648 | 10/1956 | Jazwieck | 81/58 |
| 3,640,158 | 2/1972 | Myers | 81/59.1 X |
| 3,823,625 | 7/1974 | Myers | 81/59.1 |
| 4,928,558 | 5/1990 | Makhlouf | 81/58.2 X |

*Primary Examiner*—James G. Smith
*Attorney, Agent, or Firm*—Gunn & Associates

[57] ABSTRACT

A ratchet wrench mechanism is set forth. It is constructed so that it advances on rotation in one direction and locks when attempting to rotate the ratchet in the opposite direction. It does not require incremental advances as occur with a toothed locking mechanism in the ratchet. Rather, the handle supports a socket which has a surrounding shoulder with upper and lower faces. The socket and shoulder have a gap to permit socket insertion over a bolt. The shoulder passes through wedge shaped chambers or cavities in the housing, and wedges loaded by a bias spring are forced towards the narrow end of the tapered chambers. Rotation in one direction is permitted because the wedges are retracted to the large end of the cavity, but rotation in the opposite direction is forbidden when the wedges move to the opposite and narrow end of the cavity.

15 Claims, 2 Drawing Sheets

FIG. 4
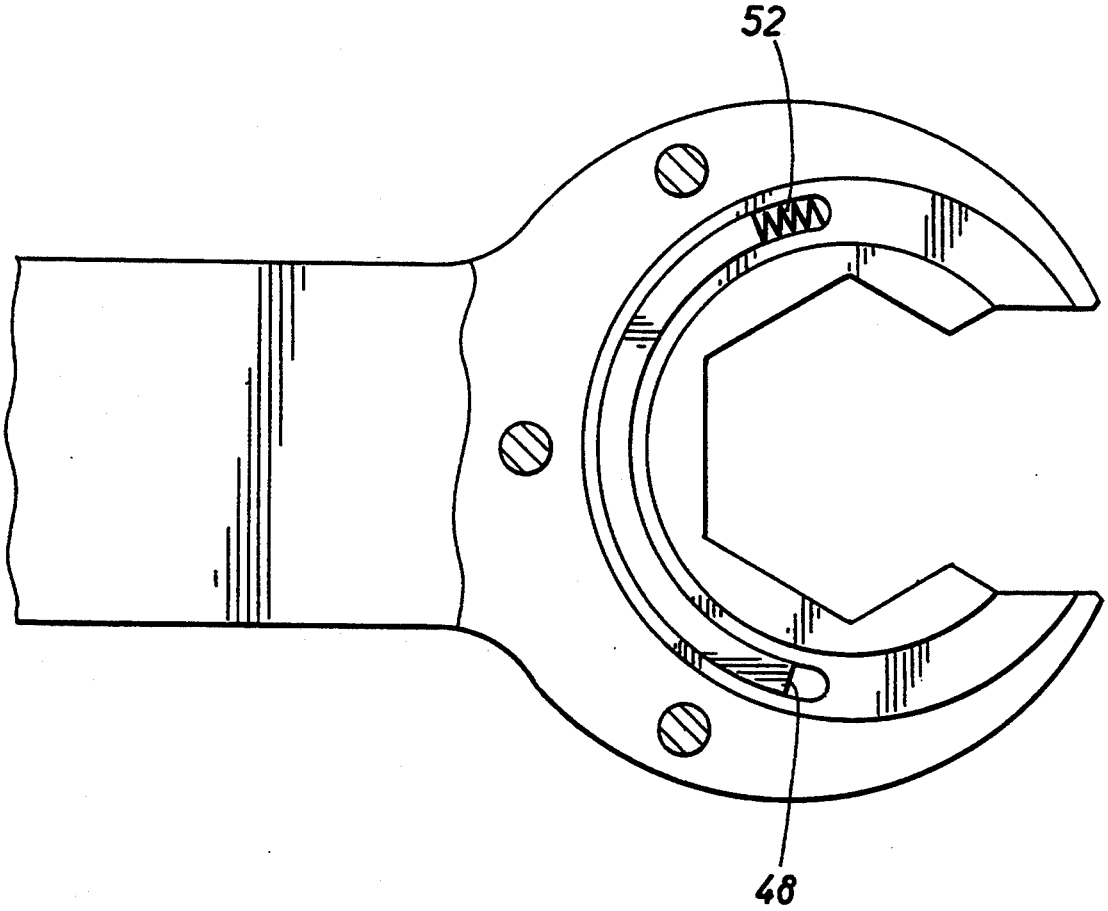
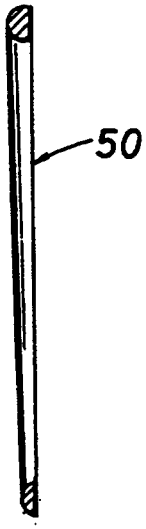
FIG. 5

RATCHET WRENCH INCLUDING TOOTHLESS DRIVE

This is a continuation in part of U.S. Ser. No. 07/937,129, filed Aug. 31, 1992, now U.S. Pat. No. 5,259,276, issued on Nov. 9, 1993.

BACKGROUND OF THE DISCLOSURE

The present disclosure is directed to a ratchet wrench mechanism, and one which is different in operation in that it does not include a ratchet mechanism which advances by a finite measure. This structure incorporates a toothless drive which thereby enables rotation by an infinitely varied amount.

In the use of hand tools, there is a well appreciated need for ratchet type mechanisms. Indeed, ratchets in conjunction with socket drives are used by practically all machinist and repair personnel. As a generalization such devices are extremely handy for service work. There is however a limitation at times arising from the physical locale at which the socket connection is somewhat constrained. Sometimes, rather than use a socket connected with a ratchet, the only choice which is permitted by the circumstances of use is to engage a nut or bolt with an open end wrench. Nonadjustable box and open end wrenches are normally available for this purpose. Especially with an open end wrench, a nut can be engaged from the side without having to slip the wrench over the head. This type of motion permits one to engage the bolt head or nut on the bolt laterally. Sometimes, that is the only access which is permitted.

One of the difficulties with use of a ratchet wrench is the fixed incremental movement. The fixed increment of travel is determined by the spacing of the teeth involved in the ratchet mechanism. These teeth are normally arranged in a regular spacing. Since the device moves a catch mechanism from the first tooth to the next tooth, each advance of the ratchet requires a finite advance. In other words, the ratchet mechanism must drive the socket through a fixed angle of rotation, or some multiple thereof. If it is convenient, the handle can be moved so far that several incremental steps are achieved during the ratchet advance. If it is not handy or if the external working space is constrained, then difficulties arise in this regard. As will be understood, if the arcuate motion of the user is constrained by half, then tightening requires twice as many ratcheting movements to achieve the same amount of wrench transferred rotation.

The foregoing is especially true in a system which utilizes a wrench which has a fixed step or lead in the ratchet mechanism. Briefly, that describes those devices which are in popular fashion nowadays. Such a device is exemplified by the disclosure in U.S. Pat. No. 3,204,496. Briefly, this patent is directed to a ratchet mechanism which uses a spring loaded FIG. 8 shaped tooth caught in a raceway on the exterior of a socket and on the interior of a housing. In U.S. Pat. No. 3,398,612 a ratchet mechanism is shown which has spheres captured in a raceway, the raceway having one wall which is a cylinder and another wall which has an undulating surface which creates a wedge shaped cavity. It is a sphere related ratchet mechanism.

Another structure is shown in U.S. Pat. No. 4,491,043 illustrating a number of different embodiments which utilize a sphere which moves into a locking or unlocking position in conjunction with a tapered cavity. Last of all U.S. Pat. No. 3,590,667 sets forth a roller as opposed to a sphere, and the roller is captured in a tapered chamber.

The device of the present disclosure can be readily distinguished from the structures described above in the four specific references noted. The present apparatus utilizes a socket of conventional six sided construction but one which omits one side so that it functions as an open end wrench or socket. The structure further utilizes a surrounding, external, centered rib, halfway between the top and bottom, which rib provides a working surface on the top and bottom. The rib is incorporated to support, in frictional sliding engagement, two opposing wedges. One wedge is located above the rib and another is located below the rib. The wedges are enclosed in internal cavities each of which has a tapered surface positioned to drive the wedge frictionally into contact with the surrounding rib around the socket. This movement by the two opposing wedges provides a clamping action, thereby preventing further movement. On clamping, the wedges prevent further rib and socket rotation and assist in locking the socket against rotation. The wedges are long enough to span the gap in the rib at the open side of the socket. In summary, the locking action occurs when the ratchet mechanism is rotated in the direction resulting in wedge latching, and that can occur after any amount of angular rotation in the opposite direction. That might occur anytime when the user operates the device in the opposite direction to achieve latching. The incremental movement is not a fixed angle of rotation as occurs with a tooth equipped ratchet mechanism.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 4 is a view similar to FIG. 3 with a portion of the top plate broken away to show the guide plate in conjunction with a long wedge and a wedge receiving chamber; and FIG. 5 is a side view of the wedge.

DETAILED DESCRIPTION OF THE PREFERRED EMBODIMENT

Figure 1:
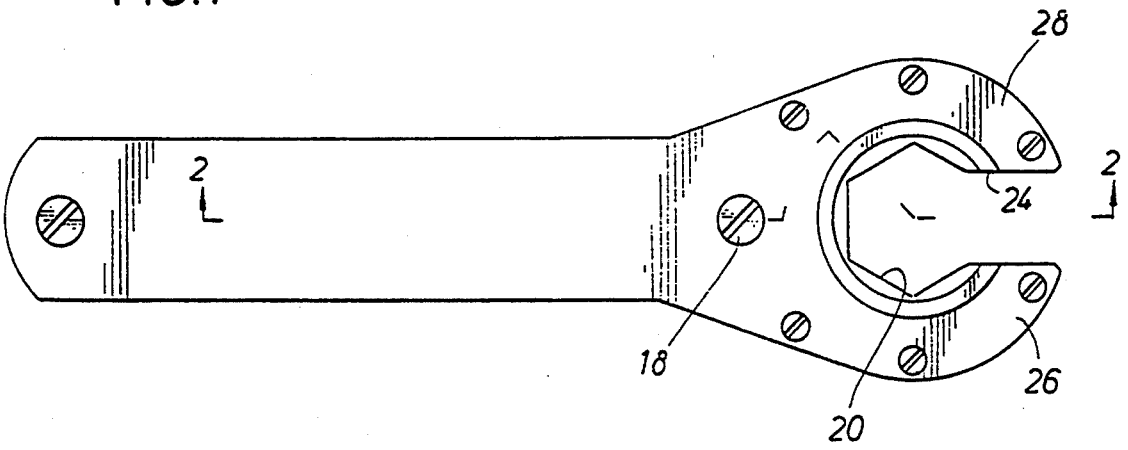
FIG. 1 is a plan view of a ratchet mechanism in accordance with the present disclosure which incorporates a socket having an open side.
Figure 2:
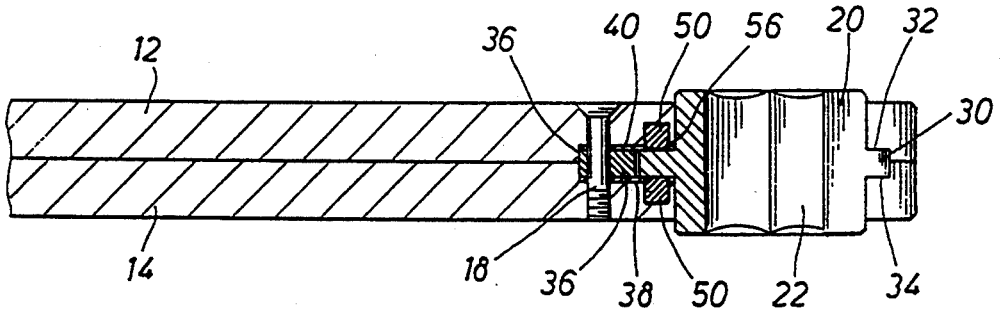
FIG. 2 is a sectional view along the line 2—2 of FIG. 1 showing details of construction of the head of the wrench which supports a socket.

Attention is now directed to FIG. 1 of the drawings where the numeral 10 identifies a ratchet wrench in accordance with the present disclosure and one similar to the patented wrench. While many details will be set forth, one of the features of this ratchet wrench is the fact that it includes a head which provides a ratchet type motion. Nevertheless, in the forward direction, the motion is not incremental. The stroke in the forward direction can be as short or as long as required. For this purpose, the disclosure will focus on FIGS. 1 and 2 considered jointly for the moment, and then details of construction will be given thereafter. Briefly, the apparatus includes upper and lower handle plates 12 and 14 which are joined together by suitable fasteners 16 and 18. These have the form of fastening bolts with tapered heads, and the handle plates 12 and 14 are provided with counter sunk openings to thereby permit fastening. Moreover, the two handle portions terminate in a circular housing which is constructed so that it encircles approximately 300° of a socket 20 which is captured in the housing. The socket 20 has sufficient height as shown in FIG. 2 so that the internal flats 22 are able to grasp the head of a bolt or a mating nut for the bolt. In particular, six flats are normally required on a bolt head in accordance with industry standards, and the socket has socket flats deployed to mate with the six flats on the bolt head. The socket however is open at one side, there being a gap 24 in the socket where one of the six flats has been omitted. This defines a gap 24 in the socket which is sufficient in width to enable the socket to slide over a bolt, and then move upwardly or downwardly as required to come into engagement with the flats on the bolt head. As will be further understood, the six flats on the interior of the socket 20 are equal to each other in width and height. The flats are enabled for grasping of the bolt head or nut. Even so, the omission of one socket flat permits the socket to slide engage the bolt stem from the side, thereby enhancing the facility in which the device is used. The socket is permanently captured in the wrench head by the encircling arms 26 and 28. The arms 26 and 28, if extended, would then define a full circle construction supporting the socket. The gap that is constructed in the socket is repeated in the wrench head so that the encircling arms 26 and 28 form an opposing support housing for structural integrity while opening at the gap to enable the bolt shaft to slide into the head and socket.

The socket is constructed with a surrounding peripheral shoulder 30. The encircling shoulder 30 is defined by a pair of parallel, outwardly facing surfaces 32 and 34. The surfaces 32 and 34 serve as locking surfaces to lock the socket. Before locking does occur, the surrounding shoulder with the surfaces 32 and 34 serves as a guide mechanism which assures that the socket remains engaged with the handle during rotation. As will be observed in FIG. 2 of the drawings, the two halves which define the handle are undercut to thereby define a circular undercut cavity sized to receive the protruding shoulder 30 so that rotation is permitted. Further, rotation is assured with minimum friction because the protruding shoulder 30 has modest clearance on all faces so that the socket 20 can rotate substantially without drag. While the socket may fit snugly against the handle, modest clearance is provided so that rotation can be readily obtained.

Figure 3:
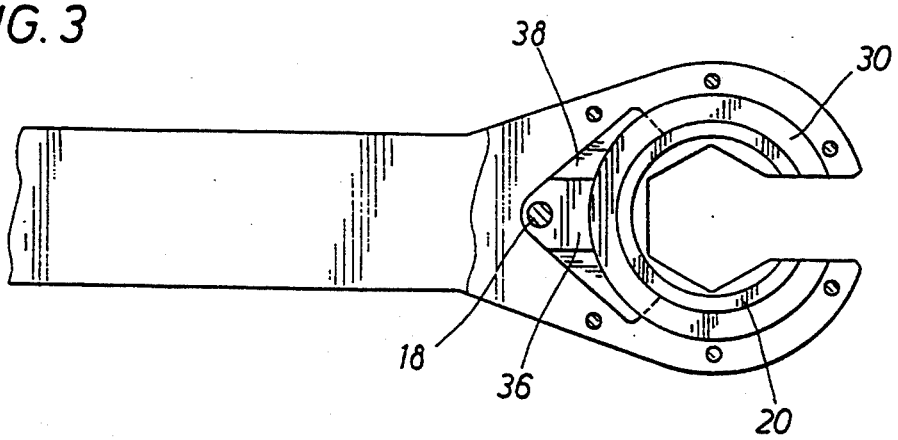
FIG. 3 is a view of the head of the socket wrench with a portion of the top plate broken away to illustrate details of construction of a guide plate.

The cavity just mentioned fits around the protruding shoulder 30. It is also enhanced by defining certain wedge receiving cavities which will be detailed later. Before going to that aspect of the structure, FIG. 3 will be observed to incorporate a portion of the handle broken away. This shows details of construction of the fastener 18 which is positioned in the two portions defining the handle to hold them together. An upstanding spacer 36 is located in the cavity and has a central opening to receive the fastener 18. When in position, the spacer 36 locks a pair of guide plates in spaced position. One guide plate is at one end of the spacer 36 and is identified by the numeral 38. Another guide plate 40 is parallel and is placed above the spacer 36. The spacer 36 in conjunction with the spaced plates 38 and 40 are held in position by the fastener 18 which passes through these components. The height of the spacer 36 is determined primarily by the thickness of the shoulder 30. This is better shown in FIG. 2 of the drawings. There, the spacer 36 is taller than and located immediately adjacent to the shoulder 30.

Consider the wedge construction in detail. In FIG. 5 of the drawings, one of the wedges 50 is illustrated and the mode of operation of that particular wedge will be extended to the opposing wedge. First, the handle portion 12 has an internal cavity with a sloping face 48 (see FIG. 4). The sloping face 48 is sized so that it has a deep end and a shallow end. The wedge 50 is placed in the cavity. A coil spring 52 urges the wedge 50 toward the opposite or deep end of the cavity. The shallow end of the cavity is represented by the symbol S while the deeper end is marked at D. There are limitations on movement of the wedge as a result of the tapering cavity. The wedge has an exposed face which bears against the opposing face of the shoulder 30. When the wedge is against the coil spring to compress it, there is more friction between the wedge and shoulder, thereby limiting wrench ratcheting action.

When the wedge is at the shallow end of the cavity which is provided for it, the wedge is jammed against the shoulder 30 and pinches the shoulder, thereby preventing rotation. The action of one wedge cannot be considered in isolation; rather, the wedge shown in FIG. 5 installed above the shoulder 30 is duplicated by a similar wedge 50 below the shoulder. The two wedges together form a pinching movement, thereby clamping the shoulder 30 and preventing rotation. This pinching movement is sufficient to stop rotation.

Returning momentarily to FIG. 2 of the drawings, it will be observed that the shoulder 30 is clamped or pinched at two locations by two edges. The shoulder 30 thus is always clamped by the two pair of wedges. While the gap 24 might be at the wedges, the wedges are sufficiently long to span the gap. The provision of two long wedges at location sufficiently spaced to assure proper clamping, enables the system to rotate continuously in one direction and yet prevents socket rotation in the opposite direction without regard to the location of the gap. During rotation, the shoulder 30 is always facing the two facing wedges.

In FIG. 4, the shoulder 30 is clamped as mentioned to prevent rotation in one direction. This confines operation of the socket to a single direction of rotation. For rotation in the opposite direction, the socket is merely flipped over by the user to get a device which rotates in the opposite direction. Rotation in a particular circumstance for a user thus requires that the mechanism be positioned so that the ratchet mechanism provides the benefit desired by the user. If it is not oriented to help the user, the user merely has to retract the socket from engagement, flip the entire tool 10 over, and then rotate in the opposite direction. In other words, the structure of the socket is limited in the direction of rotation. It can rotate only in one direction, and locks on an attempt to rotate in the opposite direction. Nevertheless, bi-directional operation is obtained from the device by virtue of the fact that it is symmetrically constructed, referring to the top and bottom faces of the system. This symmetrical construction enables one to obtain a bilateral device capable of rotation relative to a bolt head or nut. While the device internally permits rotation in only one direction, the device in application works in both directions.

Consider how this tool 10 is implemented by the user. The socket is simply engaged with a nut or bolt head. It is rotated in one direction to either tighten or loosen the nut as required. This rotation involves movement of the socket so that the wedges 50 shown in FIG. 5 are urged against the compressed springs 52, thereby grasping the shoulder 30. When the wedges are pushed to the end of the cavity, rotation of the socket is permitted. When however the socket is rotated in the opposite direction, the shoulder 30 moves in a direction causing the wedges 50 to slide towards the shallow end of the cavity provided for the wedges, and clamping occurs. Clamping even occurs over the gap 24 and further rotation is forbidden by the wedges. When the clamping action occurs, clamping is made complete without requiring rotation through an incremental advance of one tooth as occurs with a ratchet system utilizing a tooth locking mechanism. This locking occurs because there is a frictional wedging action by the wedge 50 in conjunction with the shoulder 30.

While the foregoing is directed to the preferred embodiment, the scope thereof is determined by the claims which follow:

I claim:

1. An open end wrench comprising:

(a) a handle;

(b) a socket having a plurality of flats arranged around an internal socket opening therein wherein the flats cooperate to engage a bolt head or nut constructed in accordance with an industry standard, and wherein said socket is constructed and adapted to rotate the bolt head or nut, and said socket includes a gap enabling the bolt to pass through said gap in alignment of the socket with the bolt head or nut;

(c) an encircling protruding shoulder concentric about said socket and interrupted by said gap;

(d) upper and lower parallel faces on said shoulder encircling said socket;

(e) a housing supported by said handle and encircling said socket sufficiently to hold said socket for rotation relative to said housing without escape from said housing wherein socket rotation is guided by said shoulder; and (f) long wedged means comprising a first, unitary partially-circumferential element moving between a wedged position against a first face on said shoulder and a free position wherein said long wedged means in the wedged position locks said socket against rotation in one direction, and said long wedged means permits rotation in the opposite direction, and said long wedged means is longer than said gap.

2. The apparatus of claim 1 wherein said handle terminates in said housing and includes a shoulder conforming cavity for said shoulder.

3. The apparatus of claim 1 wherein said handle is a pair of joined handle members defining said housing to encircle said socket at last partially thereabout to confine said socket for rotation.

4. The apparatus of claim 3 wherein said socket has a height sufficient to engage the flats of a bolt head or nut, and wherein said shoulder formed on the exterior of said socket circumferentially encircles said socket except at said gap, and said shoulder is guided by a conforming cavity with upper and lower faces around said shoulder.

5. The apparatus of claim 4 including a second long wedged means comprising a second unitary partially-circumferential element moving between a wedged position against a second face on said shoulder and a free position wherein said second long wedged means in the wedged position locks said socket against rotation in one direction, and said long wedged means permits rotation in the opposite direction, and said long wedged means is longer than said gap.

6. The apparatus of claim 5 wherein said ratchet means provide said wedging condition on rotation in the same direction.

7. An open end wrench comprising:

(a) a handle;

(b) a socket having a plurality of flats arranged around an internal socket opening therein wherein the flats cooperate to engage a bolt head or nut constructed in accordance with an industry standard and wherein said socket is constructed and adapted to rotate the bolt head or nut, and said socket includes a gap enabling the bolt to pass through said gap on alignment of the socket with the bolt head or nut;

(c) an encircling and exposed face concentric about said socket and interrupted by said gap wherein said face is located in a plane at right angles to the axis of rotation of said bolt head or nut;

(d) a housing supported by said handle and encircling said socket sufficiently to hold said socket for rotation relative to said housing without escape from said housing wherein rotation is guided by said face; and (e) a partially-circumferential wedge shaped member moving between a wedged position against said face and a free position wherein the wedged position locks said face and socket against rotation in one direction, and said wedge shaped means permits rotation in the opposite direction, said wedge shaped means having sufficient length to span said gap in said shoulder.

8. The apparatus of claim 7 wherein said handle terminates at said housing and includes a conforming cavity for said wedge shaped member.

9. The apparatus of claim 7 further comprising:

(a) a confining and shaped cavity in said housing having a confining surface wedging said wedge shaped member against said confining surface and also against said face; and (b) resilient means urging said wedge shaped member against said surface.

10. The apparatus of claim 7 wherein said socket has a height sufficient to engage the flats of a bolt head or nut, and wherein said face of said socket circumferentially encircles said socket except at said gap, and said face is positioned adjacent to a conforming cavity for said wedge shaped member.

11. An open end wrench comprising:

(a) a handle;

(b) a socket having a plurality of flats arranged around an internal socket opening therein wherein the flats cooperate to engage a bolt head or nut constructed in accordance with an industry standard, and wherein said socket is constructed and adapted to rotate the bolt head or nut, and said socket includes a gap enabling the bolt to pass through said gap on alignment of the socket with the bolt head or nut;

(c) a housing supported by said handle and encircling said socket sufficiently to capture and hold said socket for rotation relative to said housing without escape from said housing wherein rotation is guided by a shoulder extending radially from said socket being enclosed within said housing; and (d) a single, unitary wedge shaped means positioned above and below said shoulder moving between a wedged position and a free position wherein the wedged position locks said socket against rotation in one direction, and said wedge shaped means permits rotation in the opposite direction, said wedge shaped means spanning said shoulder gap; and (e) an encircling gripping surface concentric about said socket and interrupted by said gap wherein said surface is located to cooperatively grip said wedge shaped means for controlling rotation.

12. The apparatus of claim 11 wherein said wedge shape means provides said wedged position on rotation in the same direction.

13. The apparatus of claim 12 wherein said handle terminates at said housing and includes a conforming cavity for said wedge shaped means.

14. The apparatus of claim 11 wherein said wedge shaped means comprises:

(a) a wedged shaped member having a face in contact with said gripping surface on said socket;

(b) a confining and shaped cavity in said housing having a confining surface wedging said wedge shaped member against said confining surface and also against said gripping surface; and (c) resilient means urging said wedge shaped member against said confining surface.

15. The application of claim 11 wherein the socket has a height sufficient to engage the flats of a bolt head or nut.

* * * * *